US005419229A

United States Patent [19]

Van Doren

[11] Patent Number: 5,419,229

[45] Date of Patent: May 30, 1995

[54] LIGATURE FOR THE MOUTHPIECE OF A WIND INSTRUMENT

[75] Inventor: Bernard Van Doren, Paris, France

[73] Assignee: Etablissements Vandoren, Paris, France

[21] Appl. No.: 173,268

[22] Filed: Dec. 27, 1993

[30] Foreign Application Priority Data

Dec. 24, 1992 [FR] France ..... 92 15717

[51] Int. Cl.[6] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| 1,757,871 | 5/1930 | Miller | 84/383 R |
| 3,521,517 | 7/1970 | Sato | 84/383 R |
| 4,275,636 | 6/1981 | Van Doren | 84/383 R |
| 4,428,271 | 1/1984 | Winslow et al. | 84/383 R |

FOREIGN PATENT DOCUMENTS

| | | | |
|---|---|---|---|
| 2438311 | 4/1980 | France | 84/383 R |
| 2521755 | 8/1983 | France | 84/383 R |

*Primary Examiner*—M. L. Gellner
*Assistant Examiner*—Cassandra C. Spyrou
*Attorney, Agent, or Firm*—Foley & Lardner

[57] ABSTRACT

A ligature for a mouthpiece of a wind instrument includes a body of an elastically deformable material which is complimentary in shape to a form of the mouthpiece so as to encircle the mouthpiece and a reed disposed between the mouthpiece and the ligature. The body has two opposing portions and the ligature further includes a manually operated fastening arrangement for connecting the two opposing portions to each other and for moving the two opposing portions substantially perpendicular to a longitudinal axis of the mouthpiece to tighten and loosen the ligature about the mouthpiece.

6 Claims, 4 Drawing Sheets

LIGATURE FOR THE MOUTHPIECE OF A WIND INSTRUMENT

BACKGROUND OF THE INVENTION

1. Field of the Invention

The present invention relates to a novel ligature for the mouthpiece of a wind instrument.

2. Description of the Related Art

It is known that in instruments such as the clarinet and the saxophone, a reed is held in place on the mouthpiece of the instrument by a ring, known as a ligature, which conforms to the general shape of the mouthpiece and presses against the convex outer face of the reed, while a flat face of the reed is in contact with a flat part of the mouthpiece.

The ligature is split at a point along its shape and fastening means such as screws and threaded bores are provided on the two opposite parts adjacent the split to join them together and clamp the reed in place.

A ligature of this type is described, for example, in French patent no. 2 438 311 in the Applicant's name.

The screw fastening system of these ligatures enables a graduated clamping action to be exerted on the reed. This graduated action is regarded as highly desirable by professional or experienced musicians but is comparatively complicated to employ because it requires successive tightening of the different screws.

SUMMARY OF THE INVENTION

It is an object of the invention to overcome the above-mentioned problem by providing a ligature that requires a single action on the part of the instrumentalist both to loosen the ligature from the mouthpiece of an instrument, for the purpose of fitting to it or removing from it a reed, and to tighten the ligature onto the mouthpiece, for the purpose of fastening the reed in place on the instrument so that it may be played.

The above objects are met by a ligature for a mouthpiece of a wind instrument which includes a body of an elastically deformable material which is complimentary in shape to fit to a form of the mouthpiece so as to encircle the mouthpiece and a reed disposed between the mouthpiece and the ligature. The body has two opposing portions and the ligature further includes a manually operated fastening device for connecting the two opposing portions to each other and for moving the two opposing portions substantially perpendicular to a longitudinal axis of the mouthpiece to tighten and loosen the ligature about the mouthpiece.

In a preferred embodiment of the inventive ligature, which will be described in greater detail below, the fastening means includes at least one pin having first and second portions mounted pivotally in respective ones of openings in the opposing portions, the openings being complimentary to a shape of the first and second portions. The pin further includes a third portion connecting the first and second portions such that the first and second portions are eccentrically disposed relative to the third portion. The pin is rigidly connected to a handle such that when the handle is pivoted relative to the openings the opposing portions move due to the eccentric relationship of the first and second portions and the third portion.

The first and second portions of the pin are cylindrical and have a pivot axis which is parallel to but not continuous with the pivot axis of the third portion.

A wedge member includes a part of complementary shape for pressing against the outer surface of the reed. The wedge member may be positioned between the opposite portions of the ligature and includes a seat in which the pin of the fastening means pivots such that the wedge member is integral with the ligature.

An adjusting screw may be screwed into a threaded transverse seat in the wedge element and includes a head that can be operated from the exterior of the wedge member so that the screw may press against the reed through its end furthest from the head or through an element integral with this end so that it is possible to make fine adjustments to the clamping of the reed upon the mouthpiece in accordance with the thickness of the reed.

In an alternative embodiment, the wedge member may include two outer faces complementary in shape to the reed and have no thickness adjusting member. The seat of the wedge member in which the pin of the fastening means is engaged will be closer to one of the outer faces of the wedge member. This wedge member can be used with reeds of two different thicknesses, depending upon which outer face of the wedge member is in contact with the reed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

DETAILED DESCRIPTION OF THE PREFERRED EMBODIMENTS

Figure 2:
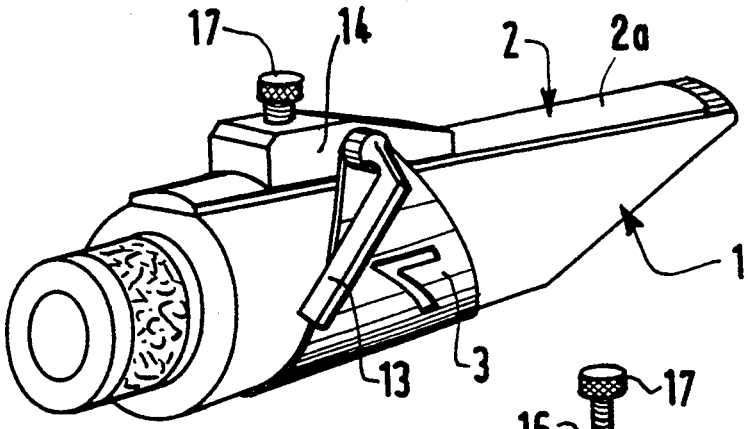
FIGS. 2 and 3 are perspective views of the clarinet mouthpiece fitted with the reed and with the ligature of FIG. 1, respectively showing the part of the mouthpiece against which the reed is pressed and the diametrically opposite part of the mouthpiece.
Figure 1:
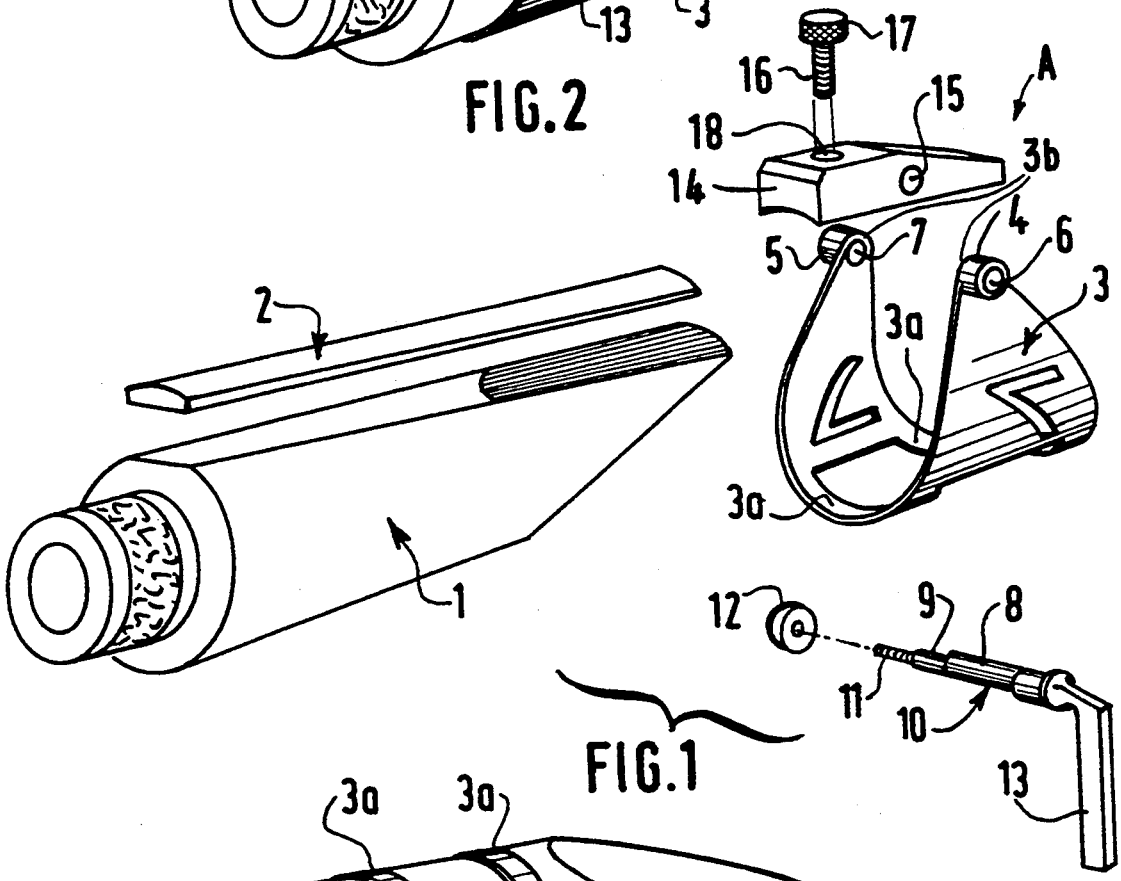
FIG. 1 is an exploded perspective view of a first embodiment of the ligature according to the invention for use with a clarinet mouthpiece and a reed intended to be used with the clarinet mouthpiece.
Figure 3:
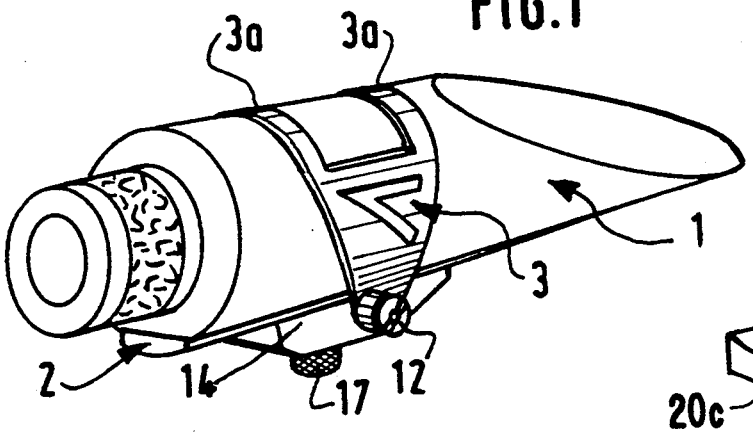

Referring to FIGS. 1–6, there is shown a mouthpiece 1 of, for example, a reed 2 and, a ligature (generally indicated as A) having a body 3. As seen in the perspective views, the ligature body 3 has the shape of a stirrup conforming to the shape of the mouthpiece 1 and, as shown in the cross section view of FIG. 4 taken along a plane perpendicular to the longitudinal axis of the mouthpiece 1, the ligature presents a U-shaped cross section. As is known per se, the ligature has ring portions 3*a* which are coaxial with the mouthpiece 1 and which are pressed against the mouthpiece 1 when the ligature is fixed in place.

In accordance with the invention, tip end portions 3*b*, 3*b* of body 3 represent the closest directly opposing portions of the body 3. The tip end portions 3*b*, 3*b* are integrally formed with respective hollow cylinder members 4, 5. Complementary cylindrical portions 19 and 9 of a pin 10 are engaged in respective coaxial cylindrical openings 6, 7 of members 4, 5. The openings 4,5 act as cylindrical seats for cylindrical portions 19, 9. A threaded end 11 of pin 10 projects out of cylindrical member 5 and is screwed into a blind nut 12, while the opposite end of the pin 10 is rigidly integrally formed with a control lever 13 projecting laterally away from member 4.

A wedge element 14 is positioned between the members 4 and 5 and presses on the outer face 2*a* of the reed 2 through a surface which is complementary in shape to the outer face 2*a* of the reed 2. A cylindrical portion 8 of pin 10 is able to pivot inside a transverse seat 15 inside the wedge element 14 in such a way that the wedge element 14 is made part of the completed ligature A. A screw 16 whose head 17 projects out of the element 14 is screwed into a threaded seat 18 in the wedge element 14, and extends toward the longitudinal axis of the mouthpiece 1, and presses through its end furthest from the head 17 against the outer surface 2*a* of the reed 2 in such a way that it is possible to adjust the clamping of the reed 2 by the ligature A in accordance with the thickness of the reed 2.

Figure 4:
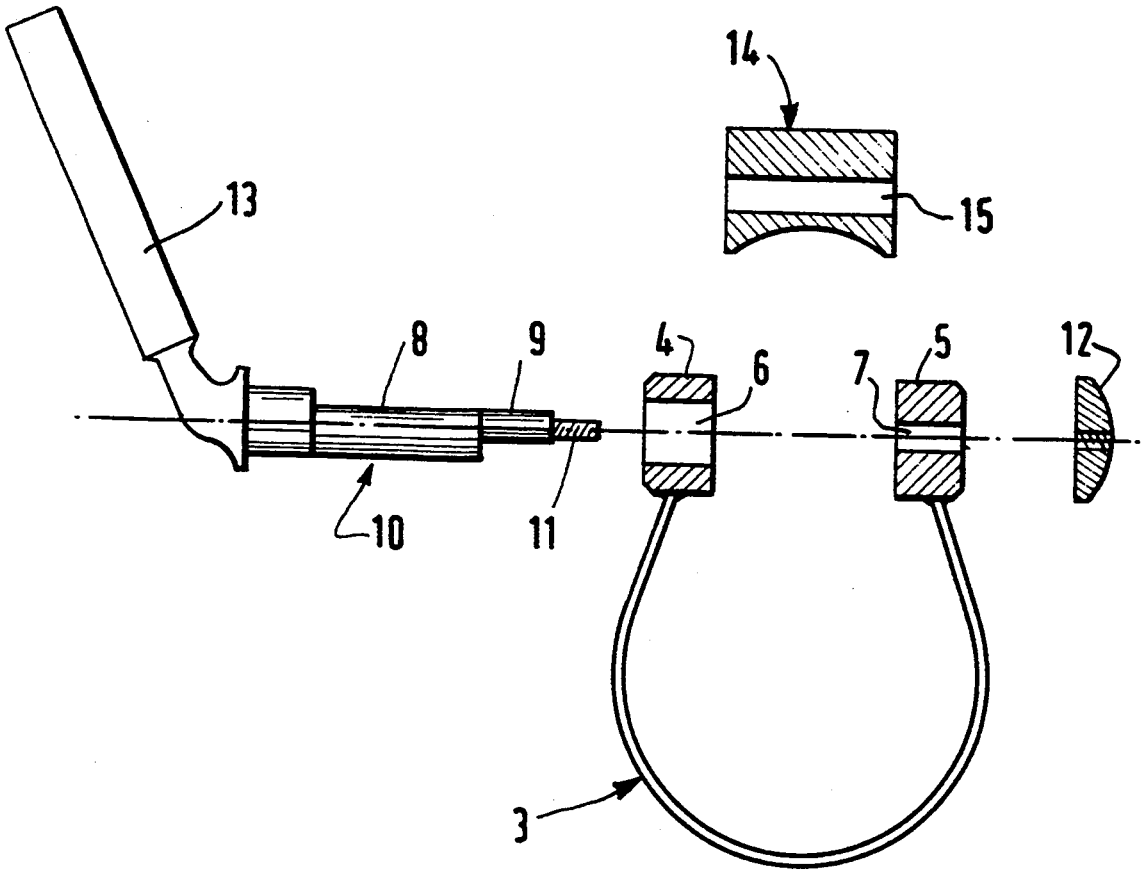
FIG. 4 is an exploded view of the ligature in partial cross section, showing its operational assembly.
Figure 5:
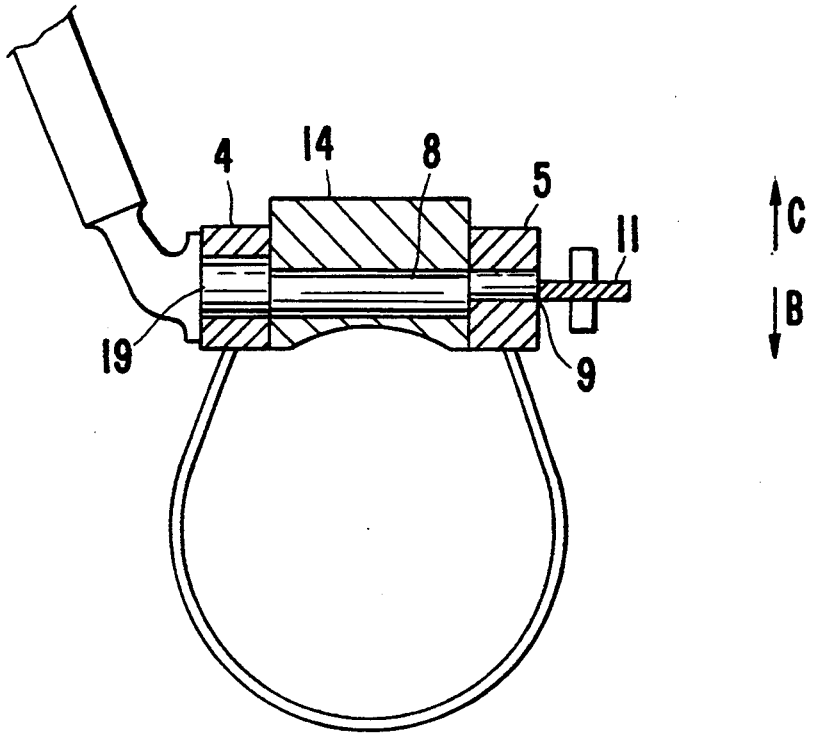
FIG. 5 is an assembled view on the ligature of FIG. 4.

The central axis of the cylindrical part 8, and the central axis of cylindrical parts 19 and 9 of the pin 10 are parallel but not continuous with each other as is clearly visible in FIG. 4. Therefore, when part 8 pivots in section 15, parts 19 and 9 pivot in their respective housings 6 and 7 and act like cams which respectively move the members 4 and 5 perpendicular to the axis of their respective seats 6 and 7. The movement of the members 4, 5 clamp the reed 2 against the mouth-piece of the clarinet, or loosen it, depending on which way the lever 13 is turned. That is, as shown in FIG. 5, the ligature A is clamped in place since cylindrical portions 19 and 9 have forced the members 4 and 5 to the uppermost position in the direction of arrow C. However, as handle 13 is rotated 180° , cylindrical portion 8 pivots within section 15 causing a corresponding eccentric movement of cylindrical portions 19, 9. Thus, the top portions of cylindrical portions 19, 9, shown in FIG. 8, will rotate to a lowest portion causing the members 4, 5 to move downward in the direction of arrow B (FIG. 5) thereby loosening the ligature. To tighten the ligature,-the handle 13 is moved opposite to that described above so that the members 4,5 move in the direction of arrow C.

The body 3 of the ligature A may, as is known, be an elastically deformable material, for example a metal, an alloy or a plastics material. The body 3 may if desired be sheathed in rubber, a flexible plastics material or an elastomer to prevent the ligature A from slipping on the mouthpiece 1 and reed 2 and to give the ligature A greater flexibility. The pin 10 and the lever 13 may be made of metal, whereas the wedge element 14 may be made of a rigid or elastically deformable plastics material.

It is of course possible to use in the ligature a wedge member adapted to only one thickness of reed, in which case it has no adjusting member.

Figure 6:
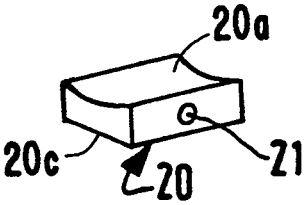
FIG. 6 is a perspective view of an alternative embodiment of a wedge member that can be used in the ligature of the invention.

FIG. 6 depicts a wedge member 20 which has no adjusting member, but which allows reeds of two different thicknesses to be used with a ligature fitted with a single wedge member of this type.

The member 20 comprises two outer faces 20*a* and 20 *c* designed to come into contact with the reed and having a complementary shape to that of the outer surface of the reed. The transverse seat 21 in which the clamping member of the ligature (not shown) is engaged, is positioned closer to one of the faces 20 *a* and 20 *c* than to the other, according to the thickness of the member 20. Depending on which face 20*a* or 20 *c* is in contact with the reed, it is possible to use this member with reeds of two different thicknesses.

Figure 7:
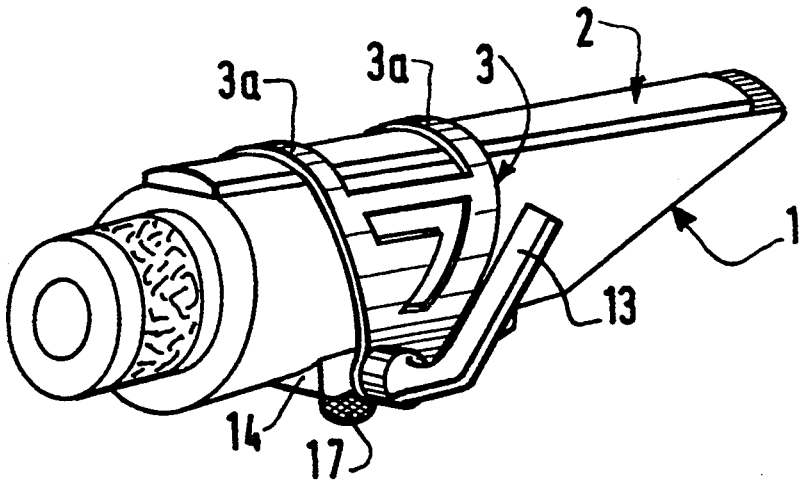
FIG. 7 illustrates another way in which the ligature of the invention in the embodiment shown in FIGS. 1 to 6 can be fitted on the mouthpiece.

FIG. 7 illustrates another way in which the ligature A described immediately above with reference to the previous figures can be assembled. In this mode of assembly, the body 3 of the ligature presses directly upon the reed 2 through the ring portions 3*a*, while the wedge element 14, which follows the shape of the clarinet mouthpiece 1, presses on the mouthpiece 1.

Figure 8:
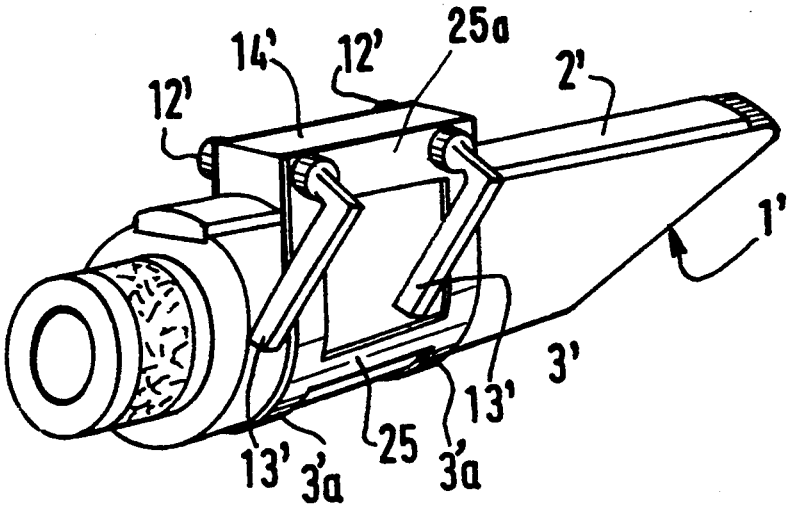
FIG. 8 is a perspective view, analogous to FIG. 2, illustrating another embodiment of the ligature according to the invention.

FIG. 8 shows another embodiment of the invention. In this figure, parts that have already been described are denoted by the same reference numerals as in previous figures, supplemented by the prime marker ′ .

In the embodiment of FIG. 8, the two ring portions 3′*a* of the body 3′ are positioned in essentially parallel planes perpendicular to the longitudinal axis of the mouthpiece 1′, and their ends are joined by bracing members 25 that are parallel to the longitudinal axis and which press laterally against the wedge element 14′ of the mouthpiece 1′. Part 25*a* of the bracing members 25 include hollow members 4′, 5′ connected by two pins 10′ (not shown) similar to the pins 10 of the embodiment described earlier. Pins 10′ are turned by levers 13′ and are housed similarly (to the FIG. 5 configuration) in parallel seats in members 4′,5′ and the wedge element 14′. Blind nuts 12′ attach to the threaded ends of pins 10.

The method of use of the embodiment of FIG. 8 is the same as for the ligature A described with reference to FIGS. 1 through 7. This alternative embodiment has however the advantage that it ensures better distribution of the clamping load exerted by the pivoting of the levers 13′ on the reed 2′ and on the mouthpiece 1′.

The invention therefore provides an extremely simple and very easy-to-operate means for fastening a reed to the mouthpiece of a wind instrument, because all that is required is to turn, through an angle typically of not more than 180° in either direction, the lever 13 or any other control member with which the pin 10 of the ligature A is provided, in order to obtain the desired result.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A ligature for a mouthpiece of a wind instrument, the ligature comprising:

a body of an elastically deformable material having a shape adapted to a form of the mouthpiece so as to encircle the mouthpiece and a reed disposed between the mouthpiece and the ligature, the body having two opposing portions;

manually operated fastening means for connecting the two opposing portions to each other and for moving the two opposing portions substantially perpendicular to a longitudinal axis of the mouthpiece to tighten and loosen the ligature about the mouthpiece; and a handle;

wherein the two opposing portions each have an opening extending therethrough, the fastening means comprises at least one pin including first and second portions mounted pivotally in respective ones of the openings, the openings have a shape complementary to a shape of the first and second portions, the pin further includes a third portion connecting the first and second portions such that the first and second portions are eccentrically disposed relative to the third portion, the pin is rigidly connected with the handle such that when the handle is pivoted relative to the openings the opposing portions of the ligature are moved due to the eccentric relationship of the first and second portions and the third portion.

2. A ligature as claimed in claims 1, wherein the first and second portions are cylindrical and each have a pivot axis which is parallel to but not continuous with a pivot axis of the third portion.

3. A ligature as claimed in claim 1, wherein the handle is a lever projecting laterally away from the pin.

4. A ligature as claimed in claim 1, further comprising a wedge member including a surface having a shape adapted to at least one of a form of the reed or the form of the mouthpiece, the wedge member being positioned between the opposing portions and comprising a seat therein into which the pin of the fastening means is pivotably disposed.

5. A ligature as claimed in claim 4, further comprising a screw having a head and wherein the wedge member has a threaded seat transverse to the seat into which the screw is threaded such that an end of the screw opposite the head extends beyond the surface of the wedge for pressing engagement with the reed.

6. A ligature as claimed in claim 4, wherein the wedge member comprises two outer faces each of which has a shape adapted to a form of at least one of a surface of the reed or a surface of the mouthpiece, and the seat of the wedge member in which the pin is pivotable is non-centrally located relative to a thickness of the wedge member so that the seat is closer to one of the two outer faces than the other.

* * * * *